US005647107A

United States Patent [19]

Brewster

[11] Patent Number: 5,647,107

[45] Date of Patent: Jul. 15, 1997

[54] SNAP GROMMET

[75] Inventor: Blair Meloy Brewster, Brooklyn Heights, N.Y.

[73] Assignee: Permar Systems, Inc., Wolcott, N.Y.

[21] Appl. No.: 462,832

[22] Filed: Jun. 5, 1995

Related U.S. Application Data

[62] Division of Ser. No. 275,135, Jul. 14, 1994, Pat. No. 5,573,825.

[51] Int. Cl.[6] ..... A43C 5/00

[52] U.S. Cl. ..... 24/713.6

[58] Field of Search ..... 16/2; 411/339, 411/508; 24/713.6, 662, 623; 40/27, 663

[56] References Cited

U.S. PATENT DOCUMENTS

| | | | |
|---|---|---|---|
| 257,750 | 5/1882 | Parcelle | 40/27 X |
| 1,235,184 | 7/1917 | Casbarian | 24/713.6 X |
| 3,887,960 | 6/1975 | Sherman | 16/2 |
| 4,562,624 | 1/1986 | Kanzaka | 24/623 X |
| 5,069,586 | 12/1991 | Casey | 24/713.6 X |

FOREIGN PATENT DOCUMENTS

| | | | |
|---|---|---|---|
| 482853 | 2/1917 | France | 411/339 |

*Primary Examiner*—James R. Brittain
*Attorney, Agent, or Firm*—Cumpston & Shaw

[57] ABSTRACT

A data-tag system for enabling data-tags to be serially printed in a laser printer in a continuous manner having a polyester substrate coated with a receiving layer for receiving toner images and non-conducting, plastic snap-grommets for reinforcing the data-tags, is obtained. Provisions are made for adding variable customized information on at least a portion of each data tag. Such data-tags are readily assembled by hand and are useful as warning signs in an industrial environment.

11 Claims, 4 Drawing Sheets

FIG. 2
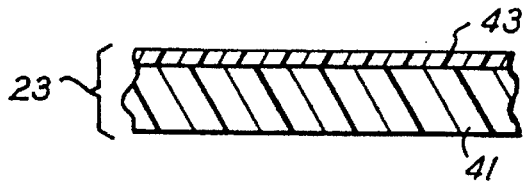
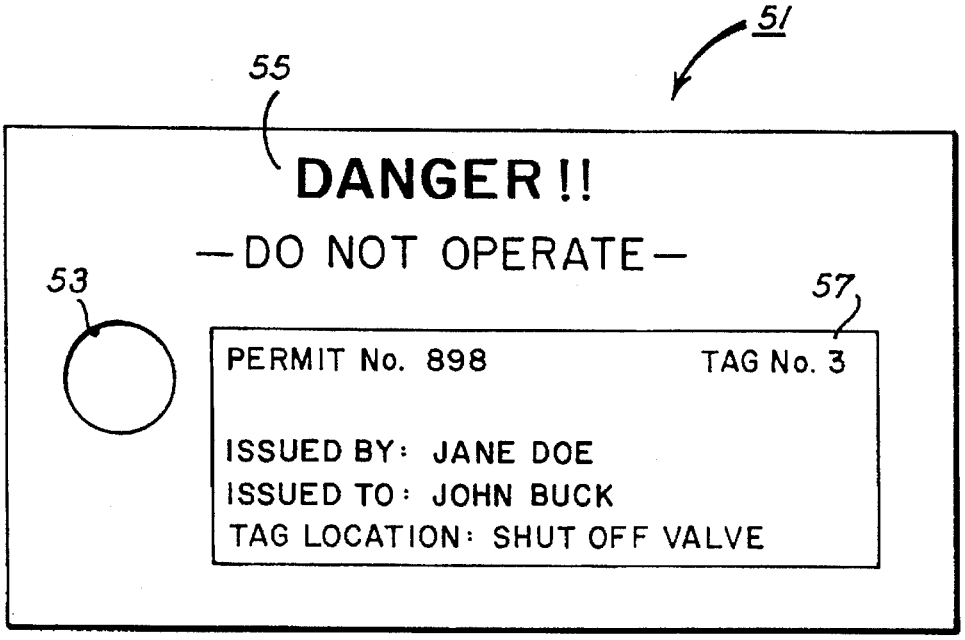
FIG. 3
FIG. 4
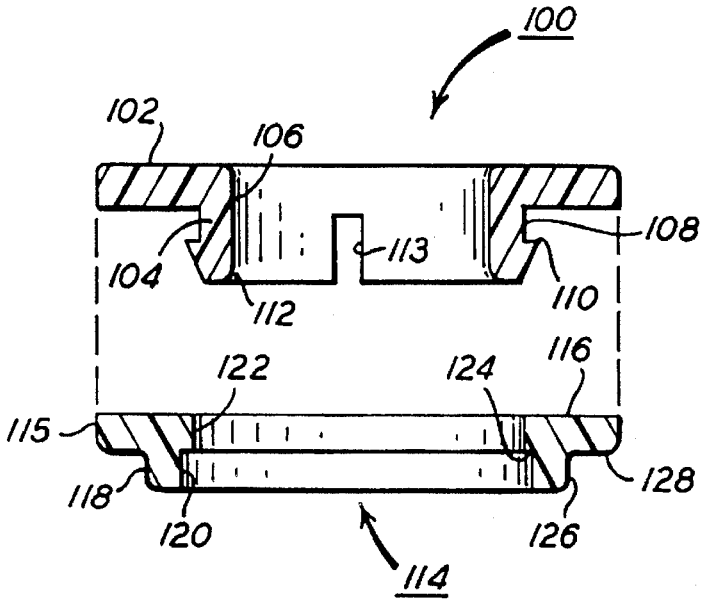

SNAP GROMMET

This is a divisional of application Ser. No. 08/275,135 filed on Jul. 14, 1994, now U.S. Pat. No. 5,573,825.

FIELD OF THE INVENTION

This invention relates generally to snap grommets, and more particularly to a non-conducting, locking, two-piece, plastic snap-grommet

BACKGROUND OF THE INVENTION

The servicing and maintenance of machines and equipment in industry in which unexpected energization or start up of the machines or equipment, or release of stored energy could cause injury to employees, requires the use of warning data-tags so that employees will not accidentally re-energize the equipment. The use of such tags is not only mandated by common sense but in some cases government regulations require their use and sets standards for the tags to prevent inadvertent or accidental removal. Some OSHA regulations, such as law 29 CFR §1910.147 published in the Federal Register Vol. 54, No. 169, 36687–36696 (Sep. 1, 1989), require a data-tag with a minimum unlocking strength of no less than 50 pounds.

A suitable data-tag should be constructed from materials which are resistant to severe environmental conditions, readily assembled and yet substantial enough to prevent its removal except with the use of excessive force or a tool. The data-tag should be imprintable with instructions that are clearly legible and will not become illegible over time under the conditions of use. A system which allows high volume, computer printing of a plurality of data-tags with variable information is also desirable.

The most common type of data-tag presently being used are vinyl or paper tags which are relatively inexpensive. However, vinyl and paper are not strong enough in some situations, especially in severe winds which can cause the tag to rip and blow away. Also vinyl and paper lose strength with aging in a relatively short period of time and have low heat resistance.

It is often desirable to add information to a data-tag either by printing or writing on the surface of the substrate. The user may also wish to add information to a large number of labels by typewriter or computer printer. Typewriters can be used for most types of labels and data-tags where individual labels are to be imprinted but they are slow and not suitable for high volume printing. To print information with a computer printer it is usual to feed a sheet of labels to an impact printer and separate the individual labels after removal of the printed sheet from the printer. In this way a large number can be printed at a time, however, the print quality of impact printers is not always satisfactory nor resistant to wear over the time of use. Non-impact printers such as laser printers are known for their speed and the quality, clarity and durability of the printing and are increasingly found in the work place. However, laser printers can reach temperatures of up to about 300° F. and are not suitable for printing on vinyl.

Polyester has a much higher melting point than vinyl. While vinyl may melt or deform at temperatures as low as 150° F., polyester is usable at temperatures of 225°–300° F. Therefore, not only can polyester be used in higher temperature environments where vinyl would melt or deform if exposed to heat, polyester based sheets can be fed through a laser printer.

In electrostatographic imaging processes such as laser printing or electrophotographic copying, a pattern or image formed by electrostatically charged thermoplastic particles of toner powder is transferred from the surface of a photoconductor or other dielectric surface to a receiver material which can be in the form of sheets or a continuous web roll. The transfer is normally accomplished by electrically charging the receiver surface to a polarity opposite to that of the toner particles and then contacting the receiver with the photoconductive surface. After transfer of the toner particles, the receiver is passed through heated rollers to fuse the toner to its surface. Commonly, the receiver for dry toner particles is plain paper and many thermoplastic toner materials adhere well to paper and form a satisfactory image or printing. When it is desired, however, to form a toner image on a plastic substrate, for example, a transparency or a label, problems arise. One problem is the difficulty of adhesion of the usual toner particles to the kinds of substrates usually preferred. A particularly preferred type of transparency substrate for toner printing is a polyester substrate such as a film of biaxially oriented poly(ethylene terephthalate). Although, this kind of substrate has desirable physical properties such as thermal stability and can withstand the high temperatures encountered in laser printers, the polyester surface does not adhere well to the usual thermoplastic toner powders.

To improve toner adhesion to plastic receivers, the prior art has applied various coatings to their surfaces. In some instances these coatings may have improved the adhesion of toner to the receiver, but other problems have occurred. For example, coated plastic sheets can be difficult to feed and transport rapidly and, when stacked in packages or in feeding trays and equilibrated to machine environment, the sheets often block or stick together. This results in multi-feeds and jams.

The prior art discloses toner receiving substrates having surface coatings that provide certain properties. For example, Hart discloses in U.S. Pat. No. 5,130,189 an imagable copy film comprising a biaxially oriented polyester substrate with an acrylic and/or methacrylic receiving layer which improves the adhesion to the substrate of toner powder applied by an electrostatic copying process, such as with a copier or laser printer. The receiving layer can also contain finely divided filler particles, for example silica, as an anti-blocking agent. A wax coating on the receiving layer can also be incorporated as an anti-static to reduce the sticking together of the sheets.

In most applications it is necessary to coat the polyester substrate with a receptive surface to receive printing and/or writing thereon. The receptive surface should be resistant to the temperatures reached by a laser printer to allow computer printing of the surface with a laser printer and it should be compatible with coloring pigments so that distinctive colored labels can be produced. In many applications, it is necessary to label the tag at the time it is applied and the coating should have good pencil receptivity.

In general, because of the design of laser printers which use a curved paper path that restricts the paper to a relatively thin and flexible profile, the thickness of a polyester substrate must conform to a relatively narrow range. Material which is too thick will not feed well through a laser printer while material which is too thin could be slight distorted and shrunk by the heat of the fuser roll causing the film to buckle or curl and later jam in the laser printer. Also unsuitable for use with laser printers are labels and tags having low melting adhesives or thin protective plastic films as components. Adhesives which melt could ooze onto the feed rollers or heat rollers and leave a gum like layer or splotches that could damage the printer and require expensive repairs.

Polyester substrates are strong and tear resistant. However, once a notch is provided at an edge of a polyester sheet it can be readily torn. A sheet of data-tags formed on a polyester substrate requires a means for separating the individual data-tags from the sheet. This is commonly a tear line of perforations or spaced slits which allows the user to rip the tag out of a sheet of tags. Older patterns in which the holes or slits are relatively large and wide apart can result in random tears in the substrate. Selection of suitable tear lines for a polyester sheet of tags is very important. In known printing operations which operate by tractor feeding continuous folded sheets of paper to the printer, the sheets are separated from each other and from the tractor feed line of holes by lines of micro perforations which minimize random tearing when the sheets are pulled apart.

Hosoya discloses in U.S. Pat. No. 4,688,826 a folded multiple sheet shipping form in which the sheet form is preprinted with shipping information on a non-impact printer or a laser printer before assembling into a label protected by an adhesively backed film. There is no suggestion of a polyester based form.

Burr in U.S. Pat. No. 4,951,970 discloses a protective label system for use with a computer printer having a plurality of removable labels adhesively attached to a carrier sheet which can be serially printed on said printer in a continuous manner and afterwards covered with a protective film which is part of the label form. The removable labels are preferably polyester.

Thoese in U.S. Pat. No. 4,202,923 discloses a drawing layer for a polyester film comprising a cellulose ester cross linked by a formaldehyde resin.

Although polyester is a strong base material for a data-tag, a tie or wire fastener easily cuts through it and a 5 mil thick data-tag rips out with less than 10 LB of pull. It is desirable therefore to reinforce the mounting hole. Known data-tags use reinforcing grommets or eyelets in their mounting holes. Such grommets or eyelets are made from brass, although some stainless steel grommets are used. The metal has to be ductile enough to bend easily in an eyeletting tool which is required to assemble the grommet to a tag. Metal grommets always require a tool and a two step operation to assemble. Metal grommets have the disadvantage that when made of less expensive materials they can rust and even more importantly, they are conductive which is a disadvantage for electrical use. When warning tags are used on high voltage transmission lines, intense electric fields are often present that may cause arcing or flashing when metal grommets are used. A non-conducting reinforcer which will increase the pull strength at the mounting hole is desirable for industrial use. Plastic snap-grommets are known for use with large banners and are designed to receive ropes for raising or holding the banners in place. Such grommets have thick broad shoulders for strength and are far too thick for mounting on the relatively small warning tags used on industrial equipment. Such plastic snap-grommets require use of a tool for assembly, are readily pried apart and are expensive. In industrial use it is frequently necessary to attach the data-tag to a lock shank. Such a large grommet is too bulky for use with a lock shank. It is so thick that you cannot thread the curved portion of the lock shank through it.

Accordingly, it is an object of this invention to provide a reinforced data-tag system which can be serially printed in a laser printer in a continuous manner by providing a thermally stable polyester substrate from 3 to 7 mils (0.075 to 0.175 mm) thick with a receptive surface coated thereon for receiving toner images, and having a mounting hole in which a non-conducting, locking, plastic, two-piece snap-grommet can be mounted.

It is another object of this invention to provide a matrix of a plurality of data-tags formed on the polyester substrate for feeding through a laser printer.

It is another object of this invention to provide a data-tag system in which a portion of each data-tag is reserved for receiving variable customized information.

It is another object of this invention to provide tear lines on the polyester substrate which allow separation of the individual data-tags without tearing of the data-tag.

It is another object of this invention to provide a non-conducting, locking, two-piece, plastic snap-grommet which can be hand assembled in the mounting hole of the data-tag.

It is another object of this invention to provide a snap-grommet which can accommodate a lock shank.

It is yet another object of this invention to provide a reinforced data-tag having a pull strength of no less than about 50 pounds (22.7 kg).

While the novel aspects of the invention are set forth with particularity in the appended claims, the invention itself, together with further objects and advantages thereof may be more readily understood by reference to the following detailed description of a presently preferred embodiment of the invention taken in conjunction with the following drawings in which:

SUMMARY OF THE INVENTION

Briefly stated and in accordance with a presently preferred embodiment of this invention, there is provided a reinforced data-tag system which can be serially printed in a laser printer in a continuous manner for use in attaching to equipment to provide a warning to users comprising:

a rectangular shaped sheet of a tear resistant, thermally stable, polyester substrate about 3 to 7 mils (0.075 to 0.175 mm) thick for being reliably fed through said laser printer, said polyester substrate having a receiving layer coated thereon for receiving toner images from the laser printer, said sheet further comprising an array of tear lines for forming a matrix of a plurality of generally rectangular shaped data-tags having opposite ends and opposite sides and for enabling separation of the data-tags, wherein each of the data-tags has a mounting hole extending through the substrate for receiving a reinforcer; and a plurality of non-conducting, locking, two-piece, plastic snap-grommets for individually mounting in said mounting hole for reinforcing the hole and receiving a fastener therein, each of the two-piece plastic snap-grommets consisting of a male and a female part, said male part comprising a flange and a locking projection for inserting into the female part, said locking projection having at least one generally U-shaped slot therein for enabling deflection of the projection and aiding insertion of the male part through the substrate mounting hole into the female part by hand, said female part comprising a flange and a receiving portion for locking with the male locking projection;

wherein the assembled reinforced data-tag has the individual coated substrate sandwiched between the flanges of the male and female parts of the snap-grommet.

In another aspect of the invention there is provided a generally rectangular shaped, laser imprintable, reinforced data-tag for use in attaching to equipment to provide a warning comprising:

a tear resistant, thermally stable, polyester substrate from about 3 to 7 mils (0.075 to 0.175 mm) thick having a mounting hole extending through the substrate for receiving a reinforcer;

a receiving layer coated on said polyester substrate for receiving toner images from a laser printer thereon; and a non-conducting, locking, two-piece, plastic snap-grommet mounted in said mounting hole for reinforcing the hole and receiving a fastener therein, said two-piece plastic snap-grommet consisting of a male and a female part, said male part comprising a flange and a locking projection for inserting into the female part, said locking projection having at least one generally U-shaped slot for enabling deflection of the projection and aiding insertion of the male part through the substrate mounting hole into the female part by hand, said female part comprising a flange and a receiving portion for locking with the male locking projection;

wherein the assembled reinforced data-tag has the coated substrate sandwiched between the flanges of the male and female parts of the snap-grommet.

In yet another aspect of the invention there is provided a data-tag matrix for use with a laser printer having a plurality of data-tags which can be serially printed in said printer in a continuous manner comprising:

a rectangular shaped sheet of a tear resistant, thermally stable, polyester substrate from about 3 to 7 mils (0.075 to 0.175 mm) thick for being reliably fed through said laser printer, said polyester substrate having a receiving layer coated thereon for receiving toner images from the laser printer, said sheet further comprising an array of tear lines for forming a matrix of a plurality of generally rectangular shaped data-tags having opposite ends and opposite sides and for enabling separation of the data-tags, wherein each of the data-tags has a mounting hole extending through the substrate for receiving a reinforcer.

In yet another aspect of the invention there is provided a non-conducting, locking, two-piece, plastic snap-grommet for reinforcing the mounting hole of a data-tag and receiving a fastener comprising:

a male and a female part;

said male part comprising a one-piece molded, plastic, annular locking part, having a continuous, ring shaped upper flange with a wall extending below an inner portion of the flange and at right angles to the flange, said wall having a straight inner side coincident with an inner edge of the flange and an outer side shaped to form a shoulder for locking with a corresponding ridge on the female part, said wall having a lower end with a concave surface on the inner side to aid insertion of the male part into the female part, said wall further having at least one generally U-shaped slot cut out of the wall below the flange to enable the wall to deflect slightly and aid insertion of the male part into the female part by hand, wherein the lower surface of the upper flange and the outer side of the wall above the shoulder are at right angles to each other;

said female part comprising a one-piece molded, plastic annular base having a continuous, ring shaped flange with a wall extending below the base flange and at right angles to the base flange, said wall having a straight inner side which is spaced at a distance from the inner side of the base flange to form a ridge for receiving the shoulder of the male part, wherein the outer side of the wall is radially connected with the lower surface of the base flange;

wherein the space between the lower surface of the upper flange and the shoulder is dimensioned to accommodate the thickness of the data-tag and the base flange of the female part of the snap-grommet.

BRIEF DESCRIPTION OF THE DRAWINGS

FIG. 2 is a section view, not to scale, of a data-tag.

FIG. 3 is a schematic illustration of a data-tag.

FIG. 4 is a section view of the male and female parts of a non-conducting, locking, two-piece, plastic snap-grommet.

DETAILED DESCRIPTION OF THE INVENTION

Figure 1:
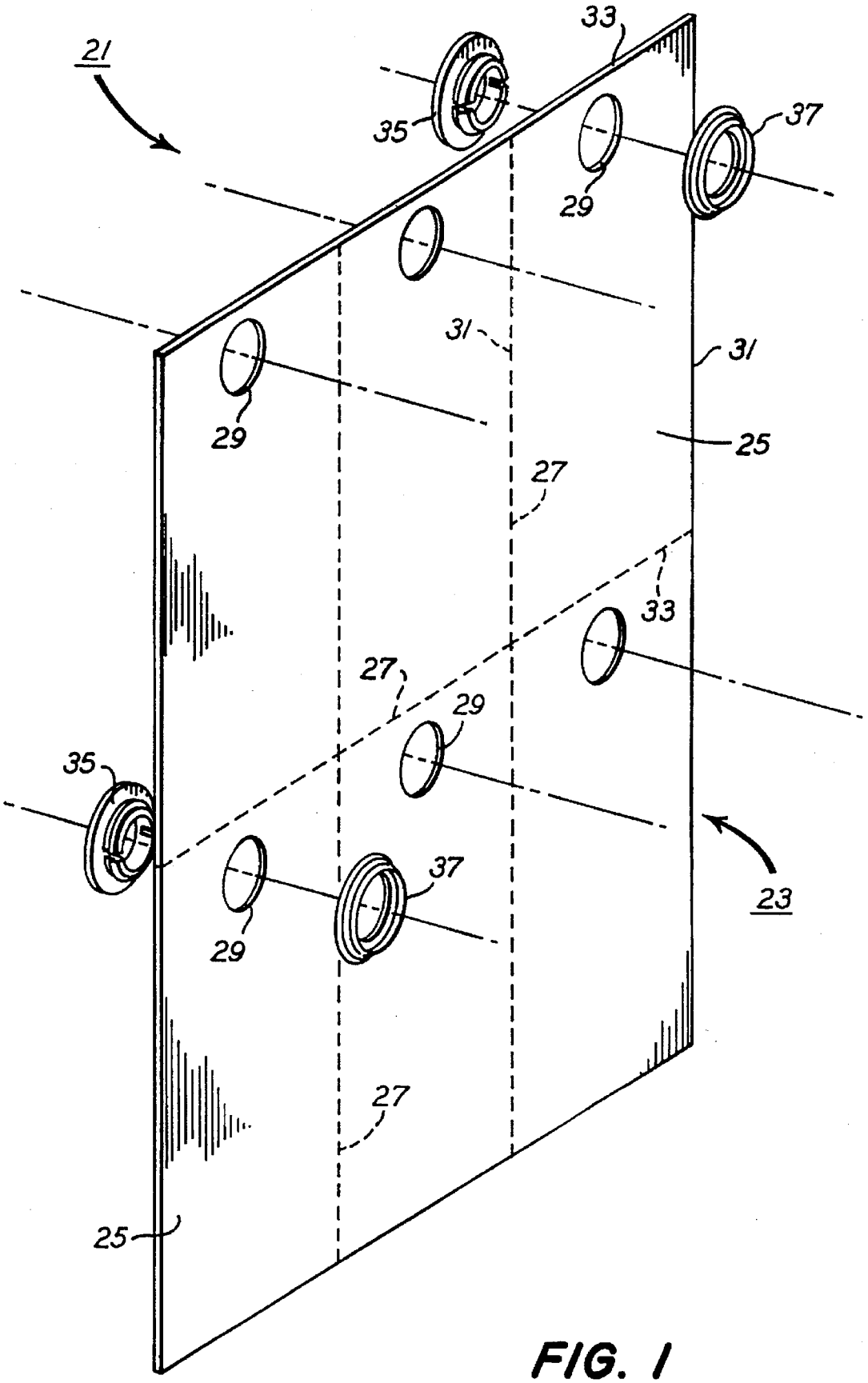
FIG. 1 is a perspective view of a data-tag system showing a matrix of data-tags and the corresponding snap-grommets.

In a first embodiment of the invention, as shown in FIG. 1, a data-tag system 21 for use in attaching to equipment to provide a warning to users is shown. The data-tag system includes a rectangular shaped sheet 23 of polyester substrate. The sheet 23 serves as a carrier matrix for a plurality of individual data-tags 25 which are separated from each other by tear lines 27. In this embodiment the edge of the sheet is also an edge of the data-tag. Each of the data-tags has a mounting hole 29 which extends through the substrate 25 and any additional layers thereon. The mounting hole is, for example, centered between opposite sides 31 and adjacent one of the opposite ends 33 of the data-tag. Each of the data-tags on the sheet is provided with a non-conducting, locking, two-piece, plastic snap-grommet consisting of a male part 35 and a female part 37 for mounting in the mounting holes. The snap-grommets are preferably mounted in the data-tags after separation of the individual data-tags from the sheet.

In a preferred embodiment of the sheet, as shown in FIG. 2, the sheet 23 includes a polyester substrate 41 and a toner receiving layer 43 coated thereon.

Suitable polyesters for forming the substrate include those derived by polymerization of one or more saturated dicarboxylic acids or their lower alkyl esters with one or more polyols. Dicarboxylic acids which may be mentioned include phthalic acid, isophthalic acid, naphthalene dicarboxylic acids, sebacic acid, adipic acid, maleic acid, 4,4'-diphenyl dicarboxylic acid and the like. Polyols which may be mentioned include ethylene glycol, propylene glycol, neopentyl glycol, 1,4-cyclohexane dimethanol, bisphenol A and the like. Such polymers may further comprise styrene or polyolefins such as polyethylene or polypropylene as modifiers. A poly(ethylene terephthalate) substrate is particularly preferred, especially such a substrate as the heat-stabilized, biaxially oriented poly(ethylene terephthalate) disclosed in U.S. Pat. No. 5,130.189.

The polyester substrate of the invention is at least about 3 to 7 mils (0.075 to 0.175 mm) thick, preferably about 5 mils (0.125 mm) thick to provide a sufficiently strong and durable data-tag for use in severe environments, and yet have a thickness which allows the substrate to be reliably fed through a laser printer. Sheets of polyester which are thicker than 7 mils (0.175 mm) will not feed well through the curved paper path of a laser printer and sheets which are thinner than 3 mils (0.075 mm) tend to distort and shrink slightly with the heat of the fuser roll and this can cause the sheet to buckle and later jam in the laser printer. Thus sheets of polyester between about 3 mils (0.075 mm) and 7 mils (0.175 mm) thick are preferred.

As discussed above in the Background Of The Invention polyester substrate surfaces do not adhere well to the usual thermoplastic toner powders, The substrate of this invention is coated with a toner receiving layer which improves the adhesion to the substrate of toner powder applied by an electrostatic coating process. Suitable receiving layers comprise a film-forming polymeric resin. Suitable resins include those obtained by polymerization of at least one monomer derived from an alkyl ester of acrylic acid or an alkyl ester of methacrylic acid. Polymers comprising ethyl acrylate and methyl methacrylate are particularly preferred. Such polymers and other suitable polymers are disclosed in U.S. Pat. No. 5,130,189 which is incorporated herein by reference.

The receiving layer can also contain other additives which improve the properties of the printing and the reliability of the feeding and transporting processes in a laser printer. To improve adhesion of the bead-containing acrylic surface layers to the polyester support the support can first be coated with a thin tie layer or subbing layer, for example less than 0.5 micron dried thickness of an acrylic polymer, that has good adhesion to both the support and the acrylic receiving layer. Such additives and subbing layers are disclosed in U.S. Pat. No. 5,130,189. The toner receiving layer can be on one or both sides of the polyester substrate.

In a preferred embodiment of the invention a polyester substrate is coated with a water insoluble, polymeric toner-receiving surface layer, comprising an acrylic resin as described in U.S. Pat. No. 5,130,189. The acrylic resin receiving layer contains substantially spherical polymeric beads or particles affixed to the polyester support by the thin acrylic polymer layer and distributed substantially uniformly across the layer. These particles are larger in diameter than the thickness of the acryl and protrude therefrom. More specifically, the average diameter of at least a portion of the polymeric beads is in the range from about 10 to 15 microns. Sheet materials of the lowest coefficient of friction are obtained when all or at least 50 weight percent of the beads are of 10 to 15 microns diameter. The concentration of the spherical beads relative to the amount of polymer support is low, e.g., in the range from about 0.05 to 2 weight percent. Consequently, the beads, in general are widely and substantially uniformly spaced apart. Transparent silicone (i.e. solid polysiloxanes) spherical beads are preferred. Especially preferred are poly(dimethyl siloxane) spherical beads such as GE SR436 beads of 10.5 to 14.5 micron average diameter which are available from General Electric Company. The acrylic polymer surface layers are formed by coating on the polyester support thin layers of a dilute, aqueous colloidal solution or emulsion of the acrylic polymer. Dispersed in the aqueous solution or emulsion are the transparent polysiloxane beads referred to above, an antistat agent and, preferably, a thickening agent. The dilute solution or emulsion contains no more than about 10 weight percent solids and, preferably, from about 3 to 7 weight percent solids. Specific formulations of the receiving layer are described in the Examples.

In the usual embodiment of the data-tag the polyester substrate is provided with printed instructions and/or graphics on the receiving layer which may be on one or both sides of the substrate. These printed instructions and/or graphics are produced in black or any suitable color or pattern of colors on the receiving layer of the sheet of data-tags by known printing methods, for example, screen or flexographic printing, or by laser printing. In some embodiments of the invention the polyester substrate is produced in color by adding suitable known dyes or pigments during manufacture of the substrate material. The receiving layer can be clear or colored with compatible known dyes or pigments.

In a preferred embodiment of the invention a portion of the data-tag receptive surface area is reserved for printing on or writing on by the user. The user adds variable customized information to the reserved area of the data-tag. The customized information can be added by typewriter or computer controlled printer. The computer allows the user to tie the printing of the tags to existing data bases, for example equipment and workers' names. In a preferred embodiment the customized information is generated by a computer controlled program and printed on the sheet of data-tags with a computer controlled laser printer. The reserved areas of the sheet of data-tags can also be written on by hand with, for example, ink or pencil. Where pencil written information is likely to be added the receiving layer should also have a pencil receptive surface.

Suitable matte finishing additives which facilitate pencil writing include finely particulate inorganic products such as silica, aluminum silicate alumina and pigments such as titanium dioxide and barium sulfate. A particularly preferred matte-finishing agent for use with polyester substrates is titanium dioxide. The matte-finishing agent can be applied along with other additives such as the toner receiving layer or as an additional layer covering the desired part of the substrate area.

FIG. 3 is a schematic illustration of an individual data-tag 51 which has been separated from a matrix of a plurality of data-tags which are identical except for any customized information which may have been added by, for example, laser printing. In this exemplary data-tag there is a mounting hole 53 centered between opposite sides and adjacent one of the opposite ends. An area 55 of the data-tag is preprinted with general instructions, such as a warning of danger or a hazardous condition as required by the customer so that all data-tags making up the matrix sheet are identical. The area 55 can be colored with one or more dyes or pigments for improving the visibility of the data-tag and to dramatize the information. The printing can be black or white or any appropriate color or combination of colors desired by the customer. A reserved area 57 on the data-tag is provided which is available for receiving variable customized information, for example, when the sheet of the matrix of data-tags is fed to a laser printer responsive to the customers program. Each data-tag of the matrix may receive the same information or different information depending on the program. Additional information can be added by the user to individual data-tags by typewriter or hand written means.

In an alternative embodiment of the sheet of data-tags the rectangular sheet of coated polyester substrate serves as a carrier for a plurality of data-tags separated from each other and the borders of the sheet by interior tear lines. The borders of the sheet are not perforated or cut with tear lines. After printing in the usual manner the individual data-tags are separated from the sheet and each other and fitted with the grommets.

In the usual embodiment of the invention the tear lines separating the data-tags are a line of perforations or spaced slits which allow the user to rip the individual data-tag out of the sheet without tearing the data-tag. A range of possible perforation patterns would be, for example:

| Teeth Size | Teeth per Inch | Gap Between Teeth |
|---|---|---|
| 0.219" | 4 | 0.031" |
| 0.014" | 36 | 0.008" |
| 0.012" | 50 | 0.008" |

Polyester substrates are stronger and more tear resistant than other substrate materials, for example paper or vinyl. However, tear lines in which the slits are large or perforation patterns in which the holes are relatively large and wide apart can result in random tears in the substrate when the user is trying to quickly rip the data-tag out of the sheet. In a preferred embodiment of the invention the line of perforations is a line of micro perforations in which the holes are much closer together, for example, the teeth count is 50 per inch and the teeth are 0.008 in. apart. Thus the data-tag is readily separated from the sheet and is less likely to tear in the wrong direction.

In practice the lines of perforations and the mounting holes can be formed at any convenient stage during the production of the matrix of data-tags. For example, they could be formed before or after pre-printing operations on the polyester based sheet are carried out and before any customized printing by the customer is performed.

In a preferred embodiment the holes and perforations are made in the die-cutting stage of forming the polyester sheets, after pre-printing.

It will be apparent to a person skilled in the art that the relative sizes and shapes of the data-tags can be varied to produce a variety of data-tags.

The grommet 35,37 of FIG. 1 is preferably made from non-conducting plastic material such as nylon, polyester, polyethylene, polycarbonate, or acrylonitrile-butadiene-styrene polymer (ABS) and the like. Suitable plastics, include, for example, Delrin nylon or Rynite polyester, both from E. I. duPont de Nemours & Co., or polyethylene from Rexene Corporation, which will resist the sawing action of fasteners. Non-conducting, locking, plastic snap-grommets consist of two parts, a male part and a female part. The two parts can be made of the same or different materials and can be of different hardness. When used to reinforce a mounting hole of a data-tag the female part is placed over the hole on one side of the data-tag and the male part is inserted from the opposite side of the data-tag through the hole and into the female part so that the data-tag is sandwiched between the two parts and the two parts are locked together. The snap-grommets can be colored for greater visibility, for example, red or a fluorescent color, and each part can be of the same or a different color.

A snap-grommet which is particularly useful with the data-tag of this invention is described in FIG. 4. The snap-grommet of the invention is particularly useful for warning data-tags because of its thinness, the secure means of locking the parts together and most particularly because it is non-conducting and is readily assembled by hand. Earlier known snap-grommets required the use of a tool such as a hammer or a mallet to force the two parts together.

The male part of the snap-grommet, FIG. 4, comprises a one-piece molded, plastic, annular locking part 100, having an upper continuous ring shaped flange 102 with a wall 104 extending below an inner portion of the flange and at right angles to the flange, said wall having a straight inner side 106 coincident with an inner edge of the flange and an outer side 108 shaped to form a shoulder 110 for locking with a corresponding ridge on the female part. The lower end of the wall has a concave surface 112 on the inner side 106, to aid insertion into the female part. The wall 104 has at least one generally U-shaped slot 113 cut out of the wall below the flange to enable the wall to deflect slightly inward when the male part is inserted into the female part. This slot feature greatly aids insertion of the male part by hand and the need of a tool to achieve insertion is eliminated. When there is more than one slot, the slots are preferably spaced symmetrically around the annular wall 104. The lower surface of the upper flange and the outer side of the wall above the shoulder are at right angles to each other and the space between the lower surface of the flange and the shoulder is dimensioned to accommodate the thickness of the data-tag and the base flange of the female part of the snap-grommet. The female part of the snap-grommet, FIG. 4, comprises a one-piece molded, plastic annular base 114, having a continuous ring shaped flange 115 with a wall 118 extending below the base flange and at right angles to the base flange, said wall having a straight inner side 120 which is spaced at a distance from the inner side 122 of the base flange to form a ridge 124 for receiving the shoulder of the male part. The outer side of the wall 126 is radially connected with the lower surface of the base flange 128.

In the preferred embodiments of the snap-grommets of the invention, the overall thickness of the snap-grommet is preferably less than about 200 mils (5 mm); the external diameter of the assembled snap-grommet is preferably at least 0.25 in. (6.25 mm) to accommodate a fastener, for example a tie-wrap, with a corresponding outside diameter of at least about 0.5 in. (12.5 mm). In one preferred embodiment of the invention, the internal diameter of the snap-grommet is at least about 0.5 in. (12.5 mm) to accommodate a lock shank, with a corresponding outside diameter of at least about 1 in. (25 mm). The slots are, for example, about 20 to 80 mils (0.5 to 2 mm) wide.

Typically a sheet of data-tags of the invention conforms to a standard letter-sized sheet (8 ½"×11") or A4 sheet and contains from 4 to 12 data tags. Sheets of 4 to 8 data tags would preferably have mounting holes to accommodate a snap-grommet with 0.5 in. (12.5 mm) id, while sheets with, for example, 12 data-tags would preferably have mounting holes to accommodate a snap-grommet with a 0.25 in. (6.25 mm) id.

The snap-grommets of this invention having one or more slots are more readily hand assembled than corresponding snap-grommets without slots. The force required to assemble a non-slot grommet is about 50 pounds (22.7 kg.) whereas the force required to assemble a 2 slot grommet is 3 to 4 pounds (1.4 to 1.8 kg.) and for a 4-slot grommet is 1 to 2 pounds (0.45 to 0.9 kg).

In industry, especially in electrical situations, lockout devices are required to ensure that warning tags are not removed without authorization. A preferred lockout device is a lock onto the shank of which a data-tag can be attached. Because of the curved shape and diameter of a lock shank a snap-grommet needs to have an internal diameter large enough to slide over the shank, and an overall outside diameter and thickness small enough to fit on the lock. It should be relatively thin so that it does not interfere with the equipment to which it is attached.

Figure 5:
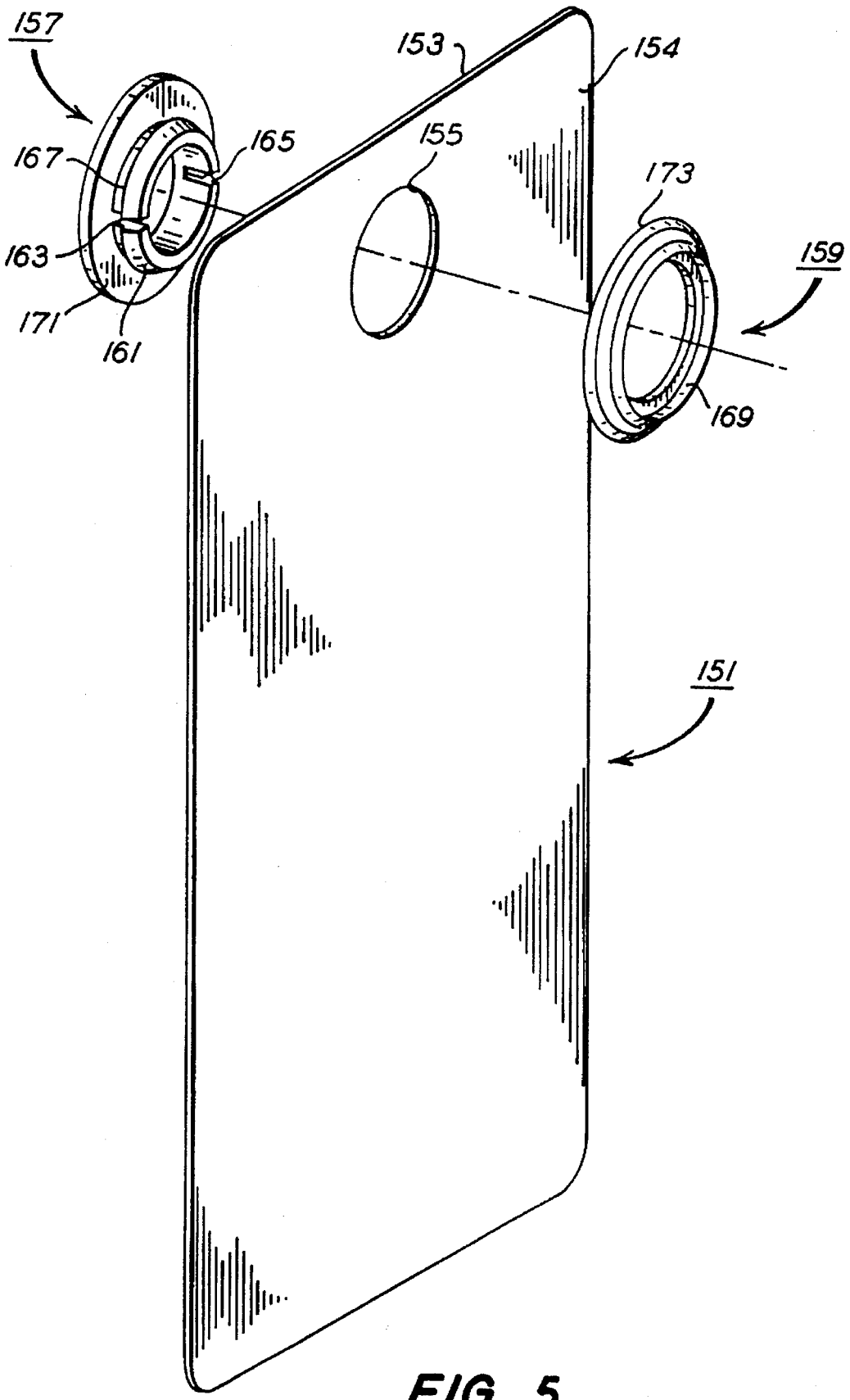
FIG. 5 is a perspective view of a data-tag showing an exploded view of the snap-grommet.

A preferred embodiment of the data-tag assembly of this invention is shown in FIG. 5. The data-tag has been separated from a matrix of a plurality of identical data-tags. The data-tag assembly 151 includes a data-tag 153 with a polyester substrate 154 coated on one or both sides with a toner receiving layer, a mounting hole 155 adjacent one end of the data-tag and a non-conducting, locking, two-piece, plastic snap-grommet consisting of a male part 157 and a female part 159. A lower wall 161 of the male part is provided with two, diametrically opposed U-shaped slots 163, 165 cut out of the wall to enable insertion of the male part through the mounting hole and into the female part by hand. The male part 157 has a shoulder 167 which readily passes over the ridge 169 of the female part because the slots allow some deflection of the walled portion 161 of the male part. Once the wall has passed over the ridge the wall rebounds to its original position and the shoulder locks against the ridge 169. The data-tag substrate 154 is firmly sandwiched between a male annular flange 171 and a female annular flange 173. There is a minimal gap between the data-tag surfaces and the adjacent flange surfaces of the snap-grommet with the result that the snap-grommet cannot be pried apart except by forcible insertion of a sharp instrument between the grommet and the data-tag surfaces.

Figure 6:
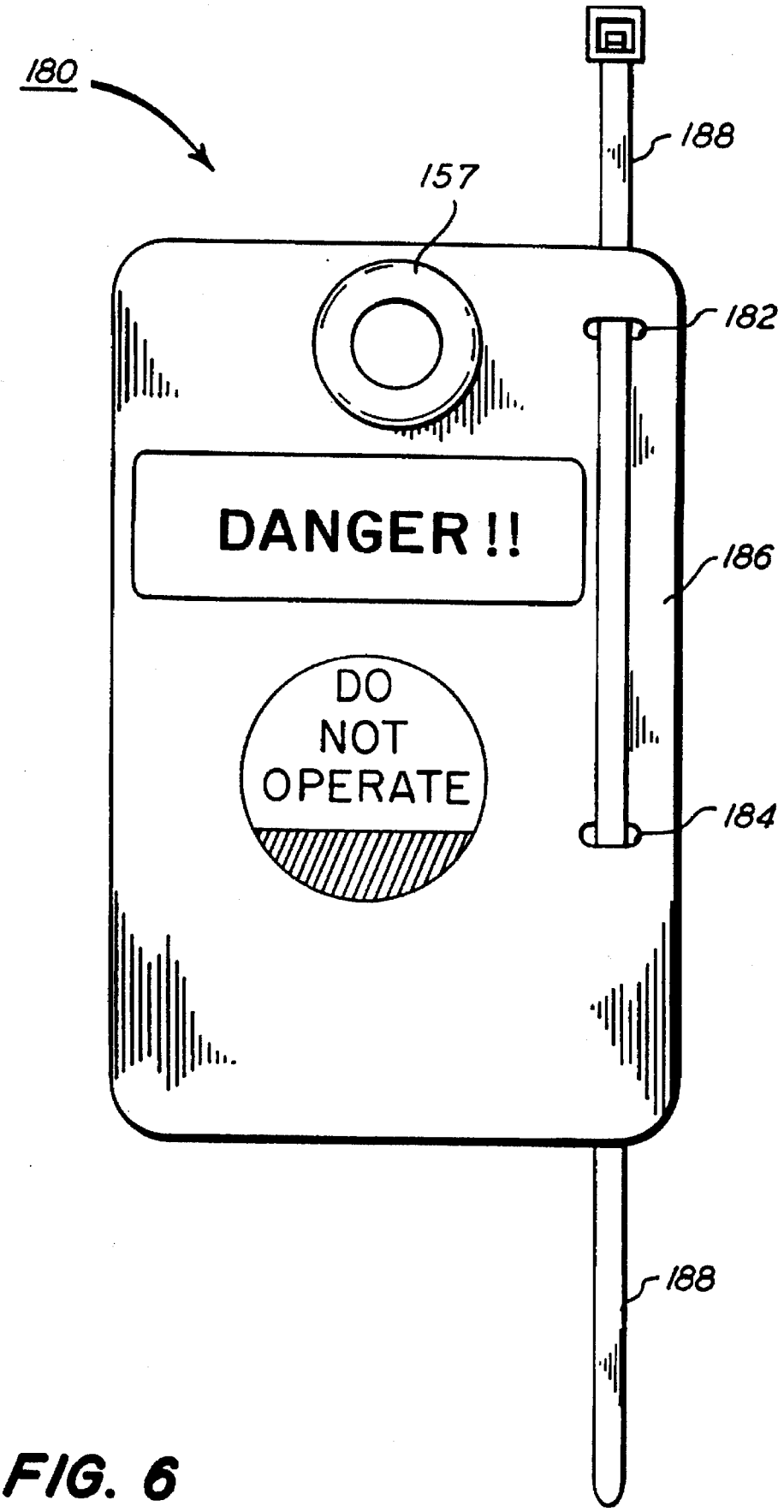
FIG. 6 is a schematic illustration of a data-tag with slots for accommodating a fastener.

In yet another embodiment of the invention, as shown in FIG. 6, a data-tag 180 is provided with a plurality of slots, for example two slots 182,184 added to an edge 186 of the data-tag to temporarily hold a fastener such as a plastic tie 188. The slots act as a sheath to hold the tie with the data-tag until it is pulled out and used to permanently attach the data-tag to equipment. This technique ensures that the tie is kept with the data-tag and virtually eliminates the problem of lost ties which occurs when the ties are packaged separately. Suitable ties include, for example, non-releasable, permanent plastic ties.

The slots can be added to the polyester sheets, for example, during the die-cutting stage of forming the polyester sheets. The position and sizes of the slots will vary with the size of the individual data-tag and the fastener. In an exemplary data-tag measuring 4×6 in. (100×150 mm), two slots, 0.125 in (3.2 mm) by 0.375 in. (9.6 mm) are cut out of the longitudinal edge at 2 in. (50 mm) and 4 in. )100 mm) from one end to accommodate a 3/16 in. (4.8 mm) wide fastener.

The data-tag system of this invention provides a reinforced data-tag featuring a toner receiving material which can receive thermoplastic toner particles and can feed reliably in laser printers, and a non-conducting, two-piece, plastic snap-grommet which is readily assembled by hand and securely locks the parts and the data-tag together. Variable customized information can readily be added to the data-tags by printing in a computer controlled laser printer. The assembled data-tag increases the pull strength of the data-tag substrate and readily accommodates a lock shank. Test For Minimum Pull Strength Of Data-tag and Snap-grommet Assembly.

Test Specimen: A data-tag measuring 2.83×5.5 in. and 5 to 6 mils thick with a mounting hole of 0.65 in. diameter centered on the long axis and 0.37 in. from one end (edge to hole edge). A two-piece, plastic snap-grommet is mounted in the hole and is free to move in the plane of the data-tag.

Test Method: Test specimens are suspended from a Chatillion 0–200 LB spring force gauge by means of a 3/8 in rapid link through the snap-grommet. A load was applied in an incremental manner to the opposite end by means of a nylon strap clamped to the data-tag. The specimens were subject to 50 LB tensile load and observed.

Test Observations: Three specimens were tested. Observed responses were identical. As the load approaches 45 LB the tags begin to deform slightly. At 50 LB the grommet hole is distorted enough to be just visible beyond the outer diameter of the grommet. Distortion did not increase within a 10 min. endurance. Data-tags which passed the 50 LB endurance test retain slight permanent deformations, however readability of graphics and other printed information on the data-tags are in no way compromised and the grommet is not ripped out.

EXAMPLES OF TONER RECEIVING LAYERS

Example 1

An aqueous coating composition was prepared by mixing an aqueous colloidal solution of Lucidene 400 acrylic polymer with water, quaternized hydroxyethyl cellulose polymer, (UCARE LK polymer), phospholipid EFA and poly(dimethyl siloxane) spherical particles of 12.5±2 microns average diameter (SR436 beads obtained from General Electric Co.), to obtain a mixture as follows:

| | |
|---|---|
| water | 95 g |
| Lucidene 400 polymer | 3.32 g |
| UCARE LK thickener | 0.84 g |
| Phospholipid EFA | 0.79 g |
| GE SR436 beads | 0.06 g |

The mixture having a viscosity of 33 cps, (as measured with a Hercules Model DV-10 viscosimeter at 4400 rpm) was coated continuously by means of a microgravure reverse roll apparatus on a moving web of poly(ethylene terephthalate) film of 4 mils (100 micron) thickness at a coverage calculated to yield a dried layer of 0.68 micron thickness. The coated film web was drawn immediately thereafter through a drying chamber 100 feet in length in contact with dry air at about 200° F. The poly(ethylene terephthalate) film was a heat-stabilized biaxially oriented film having on each side a thin (less than 0.5 micron) acrylic subbing layer as disclosed in U.S. Pat. No. 5,130,189.

Example 2

In this example the coating composition for the toner receiving layer, the support film and the method of preparation were the same as in Example 1, except that the transparent poly(dimethyl siloxane) spherical beads consisted of 45 wt % GE SR344 beads of 4.5 ±2 micron diameter and 55 wt % GE SR436 beads of 12.5±2 micron diameter. The total weight percent of such beads in the coating composition was 0.06 g as in Example 1. The coating coverage was somewhat greater to provide an acrylic layer having a dried and cured thickness of 1.5 micron.

Example 3

In this example the curable polymer component of the coating solution was Rohm and Haas AC261 acrylic emulsion which is an aqueous acrylic emulsion, of which the acrylic polymer is believed to be methyl methacrylate/butyl acrylate copolymer having a 1.4:1 mol ratio of the monomers. Other components of the coating composition were: Aerosol OT sodium dioctylsulfosuccinate, a product of American Cyanamid; GE SR346 poly(dimethyl siloxane) spherical beads of 12.5±2 micron average diameter; dimethyl diallyl ammonium chloride electrically conductive compound and water. Weight percentages of the components in the coating composition were as follows:

| Component | Wt % |
|---|---|
| Rohm and Haas AC261 polymer | 10.15 |
| Aerosol OT surfactant | 0.06 |
| Poly(dimethyl siloxane) beads | 0.10 |
| Dimethyl diallyl ammonium chloride | 0.70 |
| Water | 88.99 |

Example 4

A receiver material was prepare by coating the same coating composition as in Example 1 on both sides of a white opaque polyethylene terephthalate) film support with drying and curing as in Example 1.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. A snap-grommet comprising:

a male part having a tubular body, a flange extending from a proximal end of the tubular body, and a locking element extending from a distal end of the tubular body;

a female part having a disk-shaped engaging ring having an aperture for receiving the tubular body, an annular ridge adjacent the aperture for engaging the locking element, and an annular wall attached to the engaging ring for surrounding and limiting access to the locking element.

2. The snap-grommet of claim 1 in which the locking element is spaced from the flange by a first distance, and the disk-shaped engaging ring has a thickness slightly less than the first distance.

3. The snap-grommet of claim 1 in which the annular wall has a thickness essentially equal to a thickness of the locking element so that the male part does not extend beyond the female part when the snap-grommet is assembled.

4. The snap-grommet of claim 1 having at least one generally U-shaped slot in the tubular body to enable the tubular body to deform slightly and aid insertion of the male part into the female part by hand.

5. The snap-grommet according to claim 4 having a plurality of slots spaced symmetrically around the tubular body of the male part.

6. The snap-grommet according to claim 4 having two diametrically opposed slots cut out of the tubular body of the male part.

7. The snap-grommet according to claim 1 consisting of a non-conducting plastic.

8. The snap-grommet according to claim 7 wherein the plastic comprises nylon.

9. The snap-grommet according to claim 1 wherein said male part has an internal diameter of at least about 0.25 inches (6.25 mm).

10. The snap-grommet according to claim 1 with an overall thickness of less than about 200 mils (5 mm).

11. A snap-grommet comprising:

a male part having a tubular body, a flange extending from a proximal end of the tubular body, locking elements extending from a distal end of the tubular body, and at least one generally U-shaped slot in the tubular body to enable the tubular body to deform slightly;

a female part having a disk-shaped engaging ring having an aperture for receiving the tubular body, an annular ridge adjacent the aperture for engaging the locking elements, and an annular wall attached to the engaging ring for surrounding and limiting access to the locking elements;

wherein the locking elements are spaced from the flange by a first distance, and the disk shaped engaging ring has a thickness slightly less than the first distance; and wherein the annular wall has a thickness essentially equal to a thickness of the locking elements so that the male part does not extend beyond the female part when the snap-grommet is assembled.

* * * * *